US005609047A

United States Patent [19]

Hellman, Jr. et al.

[11] Patent Number: 5,609,047

[45] Date of Patent: Mar. 11, 1997

[54] GARMENT STEAMING DEVICE WITH SAFETY NOZZLE

[75] Inventors: Robert R. Hellman, Jr., Oxford, Conn.; Nadia Wechsler; Ephraim Wechsler, both of 300 Winston Dr. #1210, Cliffside Park, N.J. 07010

[73] Assignees: Nadia Wechsler; Ephraim Wechsler, both of Cliffside Park, N.J.

[21] Appl. No.: 467,412

[22] Filed: Jun. 6, 1995

[51] Int. Cl.[6] ..... D06F 73/00

[52] U.S. Cl. ..... 68/222; 239/538; 392/405

[58] Field of Search ..... 68/222; 223/51, 223/70, 73; 34/622; 38/77.3; 392/394, 399, 403, 405, 406; 239/538, 579

[56] References Cited

U.S. PATENT DOCUMENTS

| | | | |
|---|---|---|---|
| 2,217,729 | 10/1940 | Chancey | 392/399 X |
| 2,276,809 | 3/1942 | Utley et al. . | |
| 2,369,623 | 2/1945 | Utley et al. . | |
| 3,559,427 | 2/1971 | Baker . | |
| 3,581,529 | 6/1971 | Mitchell et al. . | |
| 3,654,780 | 4/1972 | Frank . | |
| 3,675,449 | 7/1972 | Bluestein . | |
| 3,742,629 | 7/1973 | Plasko . | |
| 3,752,373 | 8/1973 | Smith | 223/51 |
| 3,793,753 | 2/1974 | Engelbart . | |
| 3,892,945 | 7/1975 | Lerner . | |
| 3,969,607 | 7/1976 | Osrow et al. . | |
| 3,997,759 | 12/1976 | Osrow et al. . | |
| 4,426,857 | 1/1984 | Epstein | 68/222 |
| 4,532,412 | 7/1985 | Birocchi . | |
| 4,536,977 | 8/1985 | Doyel . | |
| 4,700,049 | 10/1987 | Rubin . | |
| 4,810,854 | 3/1989 | Jursich et al. | 392/405 |
| 5,123,266 | 6/1992 | Tabraham . | |
| 5,189,726 | 2/1993 | Pan . | |
| 5,305,415 | 4/1994 | Stevens . | |

FOREIGN PATENT DOCUMENTS

| | | | |
|---|---|---|---|
| 0079866 | 5/1983 | European Pat. Off. | 223/51 |

OTHER PUBLICATIONS

"insta steamer", KRH Enterprises (3 pages).

*Primary Examiner*—Philip R. Coe
*Attorney, Agent, or Firm*—Edgar H. Haug

[57] ABSTRACT

A portable garment steaming device for use in the home which emits steam through a retractable nozzle plate of a safety nozzle assembly which when retracted prevents against accidental touching of the hot nozzle plate. The garment steaming device also includes a clothes hanger assembly for hanging the article of clothing to be steamed. A water bottle compartment for supplying water to be generated as steam for the safety nozzle assembly is further provided which is detachably mounted for refilling.

39 Claims, 10 Drawing Sheets

42
44
53
54
80
82
84
85
86
88
89
90
91
92
92a
92b
93
95
97
8a
9
10
11a
12
13

FIG.16
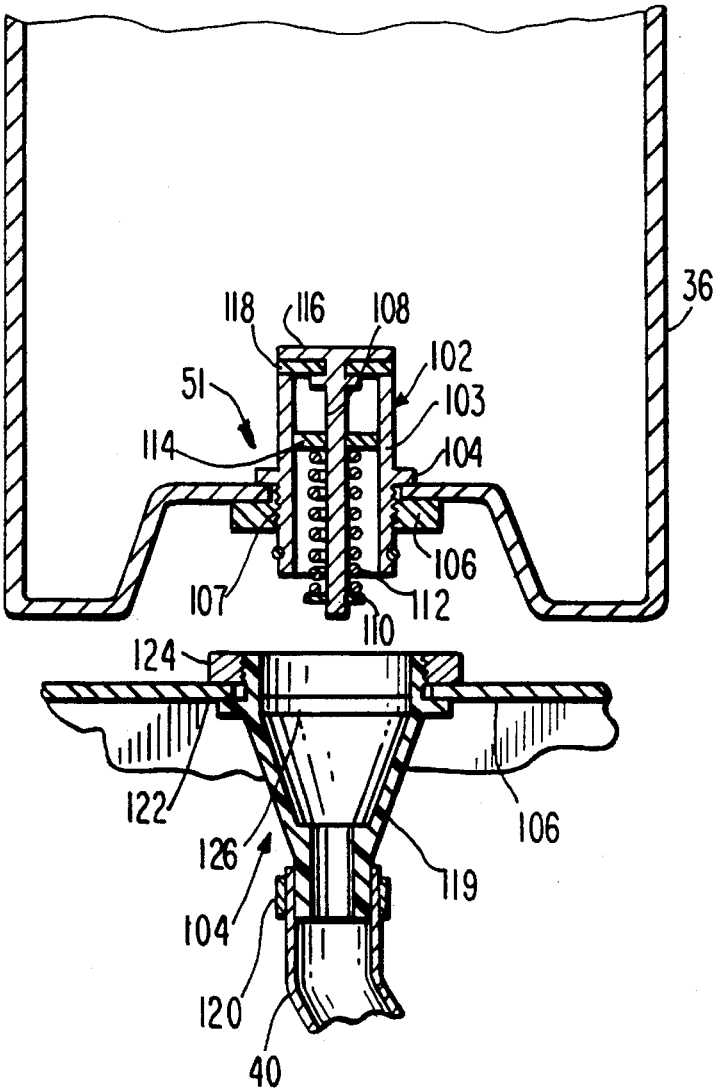
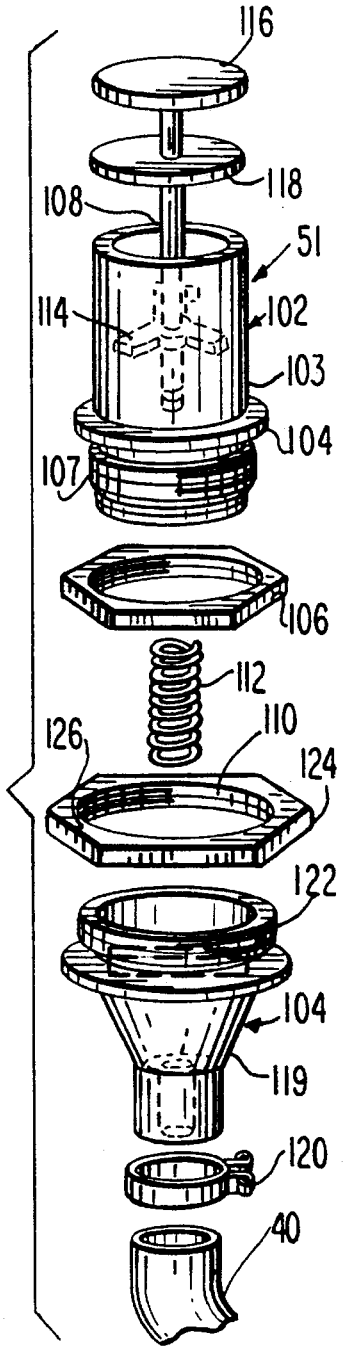
FIG.17

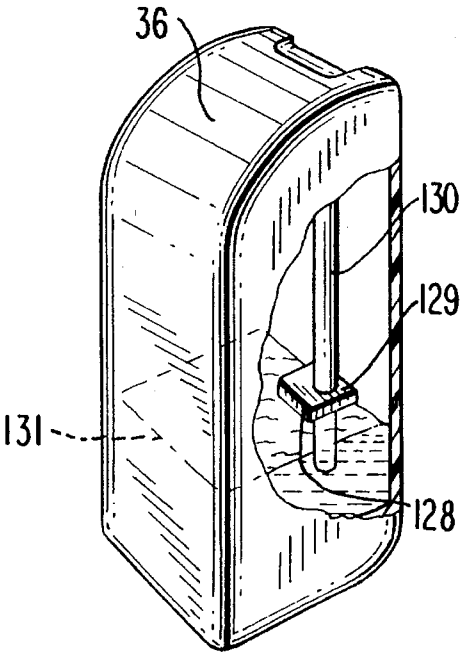
FIG. 19
FIG. 18
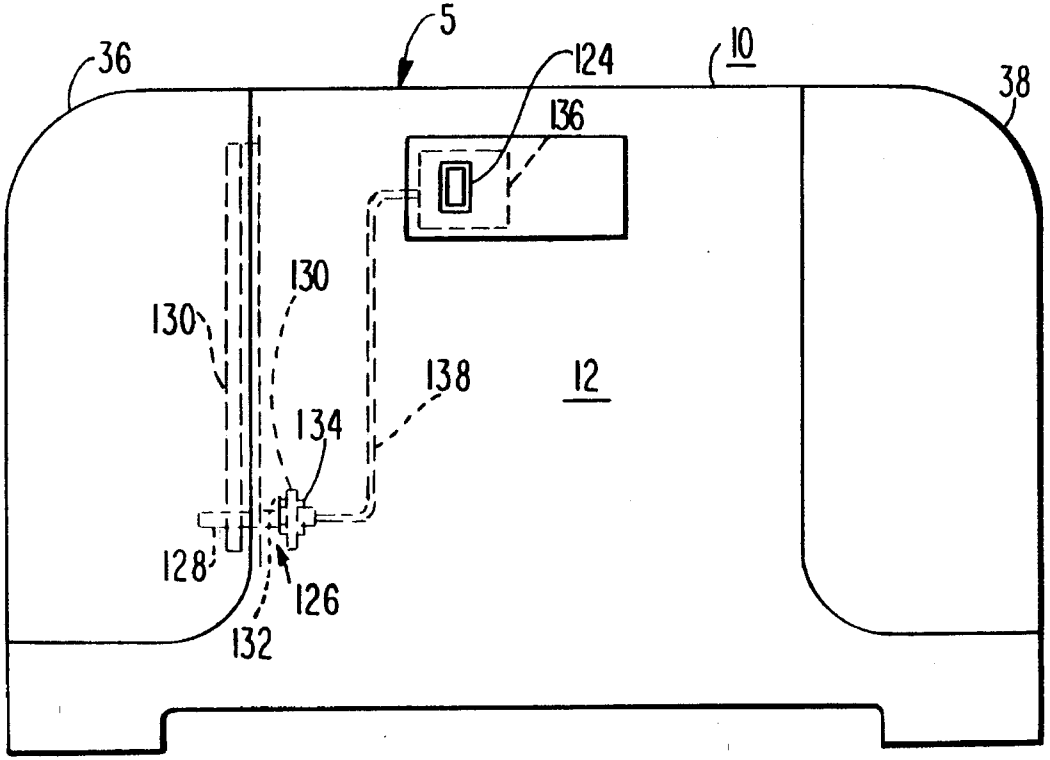
FIG. 20
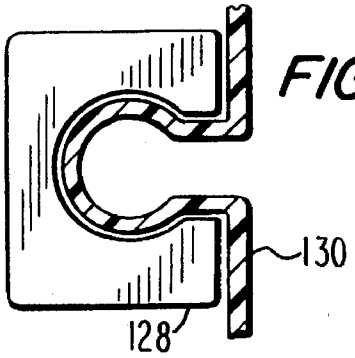

GARMENT STEAMING DEVICE WITH SAFETY NOZZLE

FIELD OF THE INVENTION

This invention relates to a device for steaming garments. More particularly, the invention relates to a portable garment steaming device which is safe and convenient for use in the home.

BACKGROUND OF THE INVENTION

Prior methods for steaming garments include the use in the dry cleaning industry of large industrial steamers which produce high pressure steam, freestanding units producing unpressurized steam and smaller hand-held units which produce atmospheric steam.

As is set forth below, problems are encountered with the use of such prior art steamers, especially in terms of the nozzles utilized through which the steam is emitted. In certain of these prior steamers, hot metal nozzles represent a potential burn hazard and these prior steamers provide no protection against accidental contact with such nozzles. Some other prior steamers employ non-metal nozzles, such as nozzles made of plastic, etc., which do not reach as high a temperature as metal nozzles. Although such non-metal nozzles are less of a burn hazard than are metal nozzles, non-metal nozzles are not as effective in removing wrinkles as metal nozzles because they do not reach as high a temperature as metal nozzles.

Typically, industrial steamers used by commercial dry cleaners which produce high pressure steam are inappropriate for home use due to their size, capacity and high cost.

Moreover, prior freestanding steamers using unpressurized steam, are designed for continuous operation in clothing stores, tailor shops and the like. These freestanding steamers are generally poorly suited for widespread use in the home due to their limited safety features as far as low water shut off, lack of protection against accidental contact with the hot nozzle, their bulk and stability. Also, these prior art steamers employ water bottles that cannot be removed without causing spillage of any water remaining in the bottle and are therefore, inconvenient for use in the home. In addition, prior handheld steamers which produce atmospheric pressure steam lack sufficient strength to adequately remove wrinkles from clothing quickly and efficiently, as typically the jets utilized therein are not strong enough to perform in a sufficient manner in a reasonable amount of time. In addition, these hand-held steamers require separate arrangements for holding garments in place (i.e., for placing the hanger), have limited water reservoirs and have no low level shut off features.

A need exists for an improved garment steamer which offers the user protection against burning as a result of contact with the nozzle. A need also exists for a household steamer that offers stability and storability, as well as a high standard of performance. There also exists a need for a garment steamer that uses a quick disconnect water bottle which can be removed from the steamer and refilled conveniently without causing spillage of water remaining in the bottle.

OBJECTS OF THE INVENTION

Therefore, it is an object of the present invention to provide a garment steaming device which avoids the aforementioned disadvantages of the prior art.

An additional object of the present invention is to provide a garment steaming device which is portable and suitable for use in the home.

A further object of the invention is to provide a garment steaming device which is compact and, therefore, easily stored in the home.

Still another object of the present invention is to provide a garment steaming device which provides for fast operation over a large surface area and allows access to hard to reach places of the clothing article to be steamed.

Another object of the invention is to provide a garment steaming device which protects the user against burning as a result of contact with the nozzle.

A further object of the present invention is to provide a garment steaming device which includes an integral arrangement for holding the garments in place during steaming.

Still another object of the present invention is to provide a garment steaming device which includes a quick disconnect water bottle which results in the ability to conveniently remove the water bottle without causing spillage of the remaining water in the bottle.

It is a further object of the invention to provide a garment steaming device which provides for added stability.

Various other objects, advantages and features of the present invention will become readily apparent from the ensuing detailed description and the novel features will be particularly pointed out in the appended claims.

SUMMARY OF THE INVENTION

In accordance with the present invention, a novel garment steaming device is provided that is portable and suitable for use in the home. The present invention provides a garment steaming device that is easily stored in a closet or bathroom or hung on a wall. The steamer includes a housing that is stabilized by a rotating foot. Moreover, the bottom of the housing is comprised of a smooth rounded surface to allow for sliding the garment steaming device along a floor.

The garment steaming device further includes a flexible hose which is connected at one end to the housing. The hose is made of a flexible and relatively heat resistant material. It is therefore safe and comfortable to the touch even when steam at a temperature up to 212° F. passes therethrough. When the steamer is not in use, the hose can be stored in the housing or externally. A safety nozzle is connected to the opposite end of the hose. The safety nozzle has a metal plate with perforated holes of a predetermined configuration on the plate to allow optimal steam output.

In accordance with one of the general objects of the present invention, the nozzle plate of the safety nozzle of the garment steamer of the present invention is inaccessible to accidental contact. In order to achieve this result, when not in use, the nozzle plate is surrounded by a heat resistant nozzle cover assembly. In a preferred embodiment, to operate the steamer, the user turns a knob which is connected to the nozzle plate and thereby rotates the nozzle plate so that it faces outside of the cover assembly and is exposed to the air to permit use. This feature greatly reduces the danger of burning due to the accidental touching of the hot nozzle plate.

The safety nozzle of the garment steaming device of the present invention is of a pre-determined angular shape which provides for fast operation over a large surface area and allows access to hard to reach places of the clothing article to be steamed, such as under shirts and collars.

Additionally, the garment steaming device of the present invention includes a quick disconnect water bottle compartment which is removable from the housing without causing spillage of the water remaining in the bottle. The garment steaming device of the present invention also includes a sensor assembly for indicating when the level of water in the water bottle compartment reaches a low level.

The garment steaming device of the present invention also has provision for holding a garment in place during steaming. In this garment steamer, a telescoping pole is connected to the base of the housing. A hanger is connected to the top of the pole for supporting garments. When the steamer is not in use, the pole can be conveniently collapsed into the base for storage. The hanger can then be adapted by means of a pivot assembly for use as a carrying handle.

Thus, the present invention provides a steamer that is suitable for household use and is easily stored in a closet or hung on a door or wall. It has a safety nozzle which is designed to prevent accidental touching of the hot nozzle plate. At the same time, the nozzle is designed to allow fast operation over large surfaces and to allow access to hard to reach places such as under shirt collars. The garment steaming device of the present invention is also provided with a rotating foot which provides for added stability.

BRIEF DESCRIPTIONS OF THE DRAWINGS

The following detailed description, given by way of example, will best be understood in conjunction with the accompanying drawings in which.

Figures 8, 9, 11:
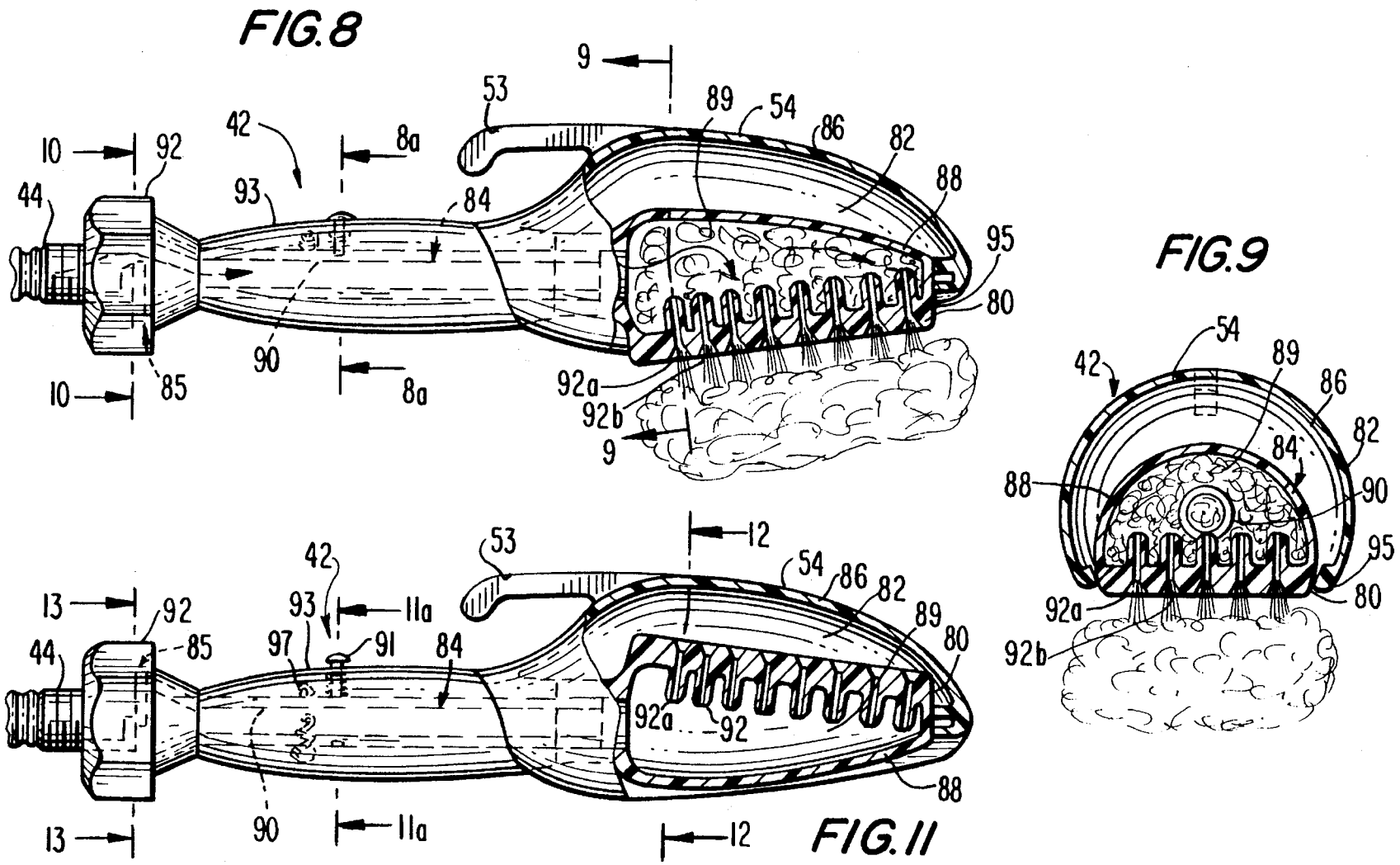
FIG. 8 is a front cross-sectional view of a preferred embodiment of a safety nozzle taken along line 8—8 of FIG. 5 with the safety nozzle thereof in its open or use position.
Figure 8A:
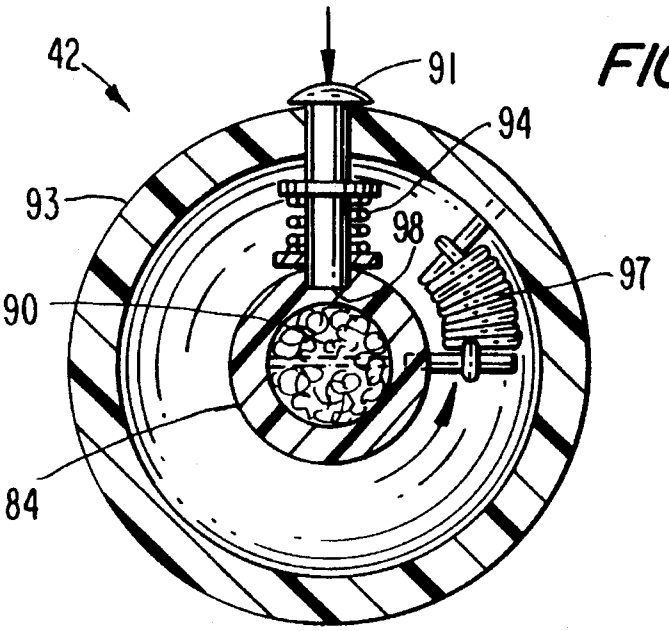

FIG. 8*a* is a side cross-sectional view of the safety nozzle of FIG. 8 taken line 8*a*—8*a* of FIG. 8.

FIG. 9 is a side cross-sectional view of the safety nozzle of FIG. 8 taken along line 9—9 of FIG. 8.

Figure 10:
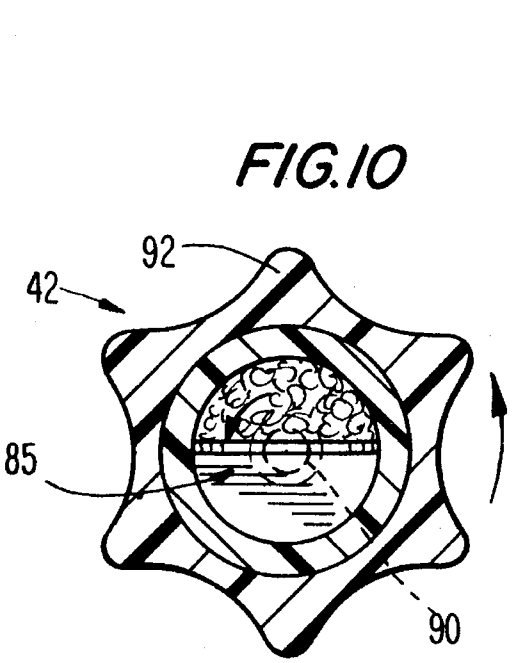

FIG. 10 is a side elevational view of the safety nozzle of FIG. 8 taken along line 10—10 of FIG. 8.

FIG. 11 is a front cross-sectional view of the safety wand of FIG. 8 with the safety nozzle thereof in its closed position.

Figure 11A:
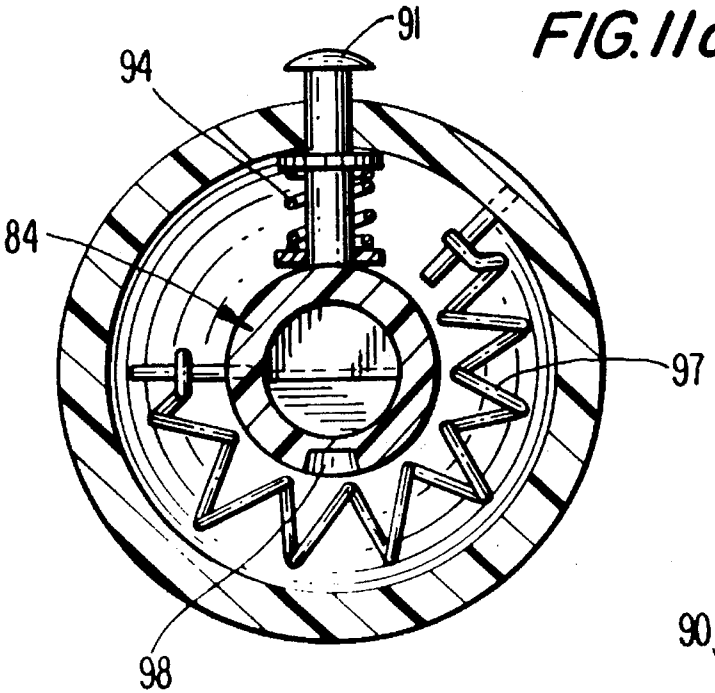

FIG. 11*a* is a side cross-sectional view of the safety nozzle of FIG. 11 taken along line 11*a*—11*a* FIG. 11.

Figure 12:
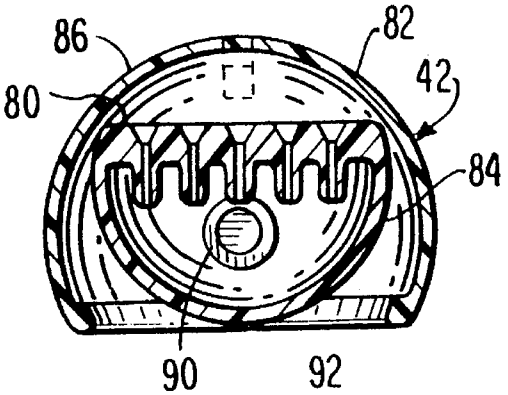

FIG. 12 is a side elevational view of the safety nozzle of FIG. 11 taken along line 12—12 of FIG. 11.

Figure 13:
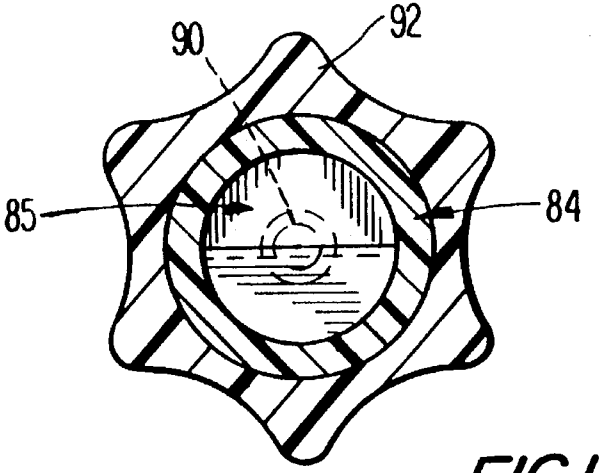

FIG. 13 is a side elevational view of the safety nozzle of FIG. 11 taken along line 13-13 of FIG. 11.

Figure 14:
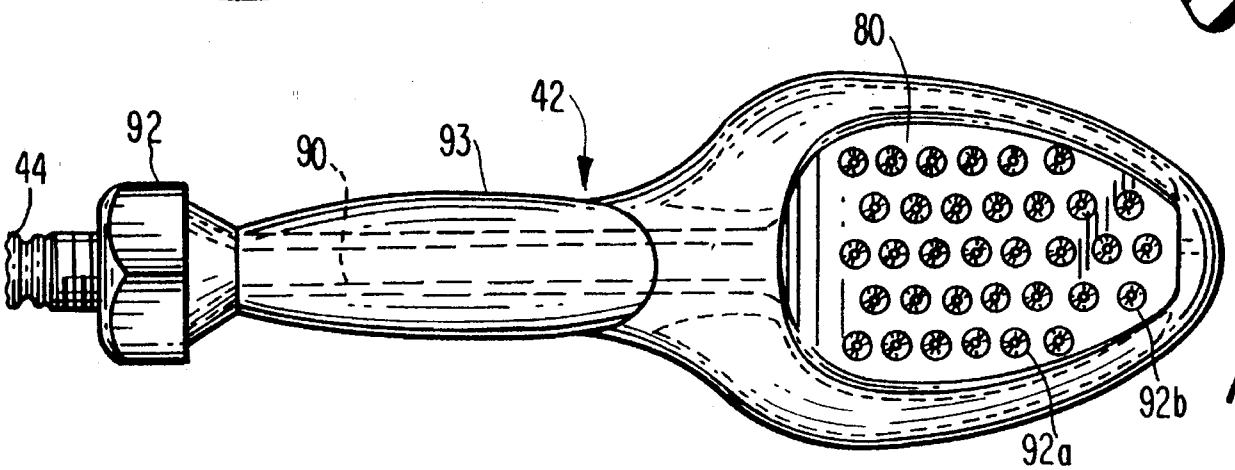

FIG. 14 is a bottom elevational view of the safety nozzle of FIG. 10.

Figure 1:
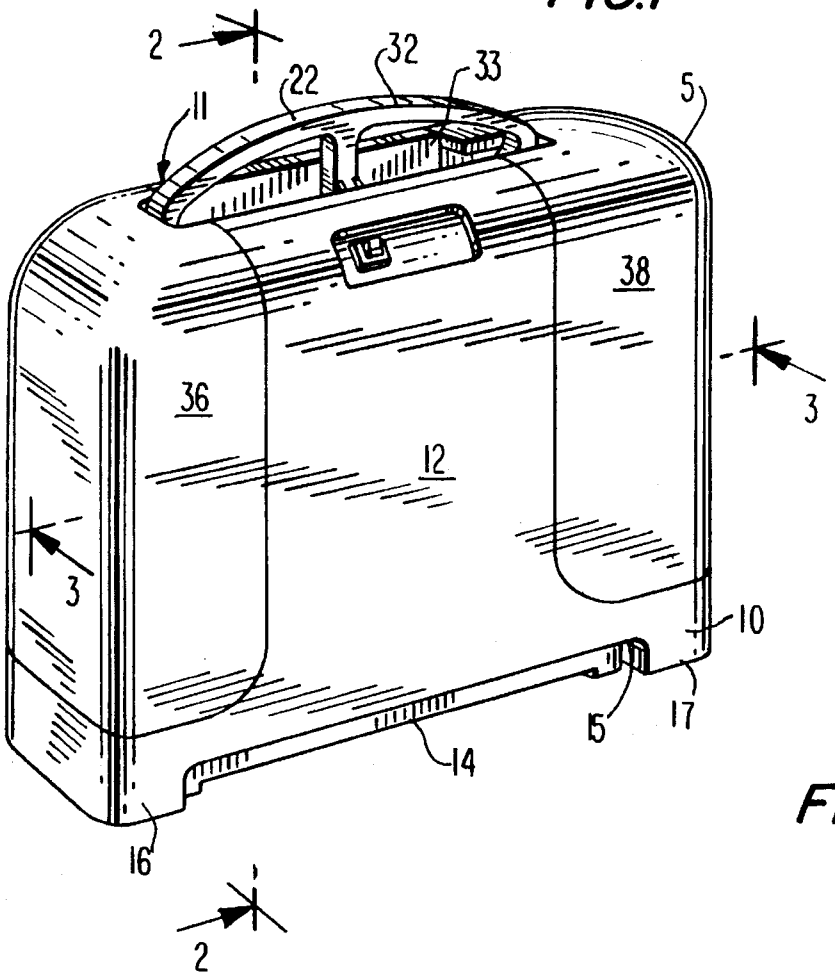
FIG. 1 is a front perspective view of a preferred embodiment of a garment steaming device in accordance with the teachings of the present invention.
Figure 15:
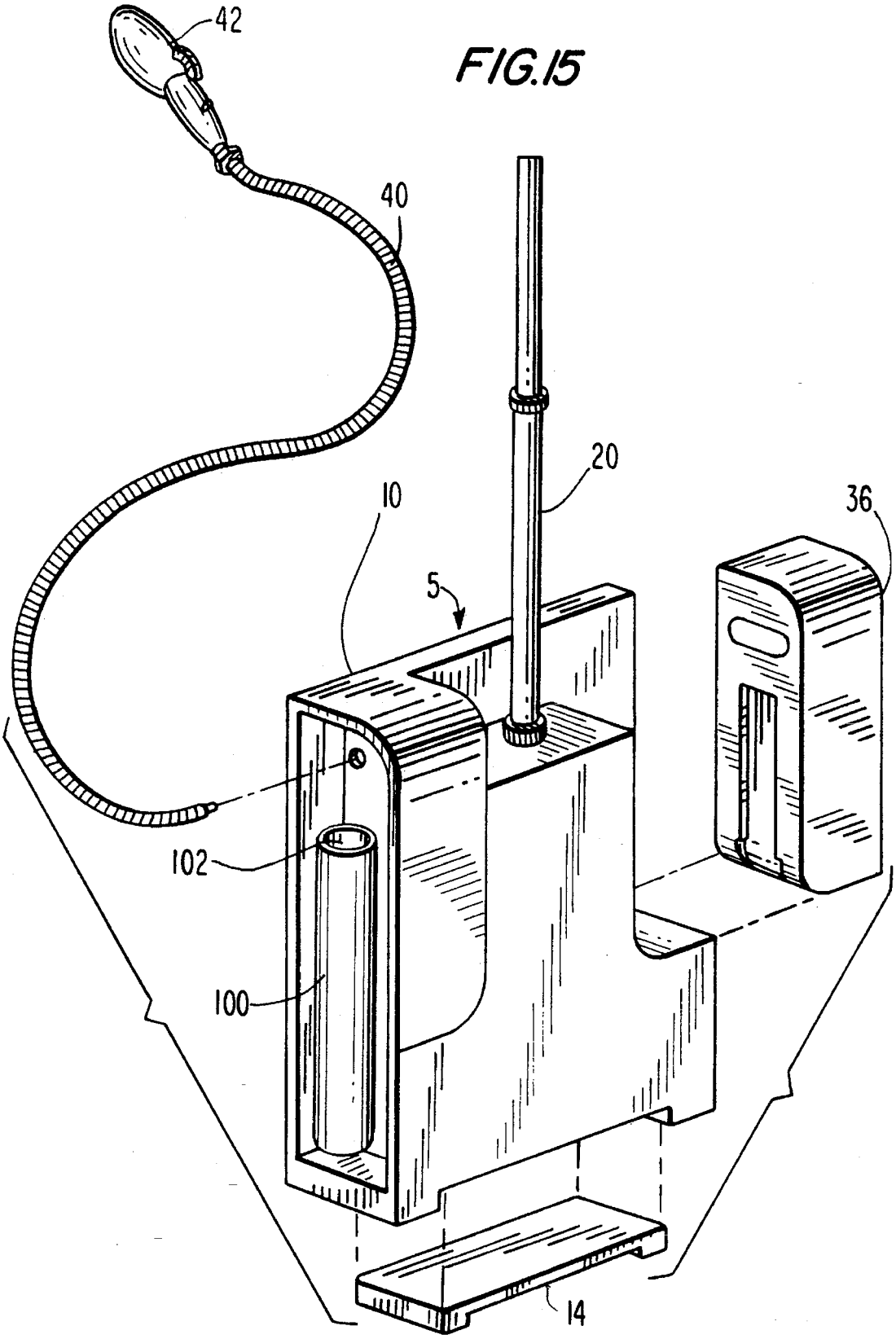

FIG. 15 is a front perspective view of the garment steaming device of FIG. 1 specifically illustrating the water bottle compartment disconnected from the outer housing and the safety nozzle/hose cavity formed externally in the outer housing.

FIG. 16 is a front elevational view illustrating the connection of the water bottle compartment to the outer housing in the garment steaming device of the present invention.

FIG. 17 is an enlarged exploded view of the coupling element for coupling the water bottle compartment to the outer housing in the garment steaming device of the present invention.

FIG. 18 is a front elevational view of the garment steaming device of FIG. 1 specifically illustrating the low water level sensor incorporated therein.

FIG. 19 is a front perspective view of the water bottle compartment of the garment steaming device of FIG. 1 specifically illustrating the movable float with vinyl magnet of the low water level sensor of FIG. 18.

FIG. 20 is a top plan view of the magnet float incorporated in a keyhole of the water bottle compartment of FIG. 19.

DETAILED DESCRIPTION OF CERTAIN PREFERRED EMBODIMENTS

Figure 2:
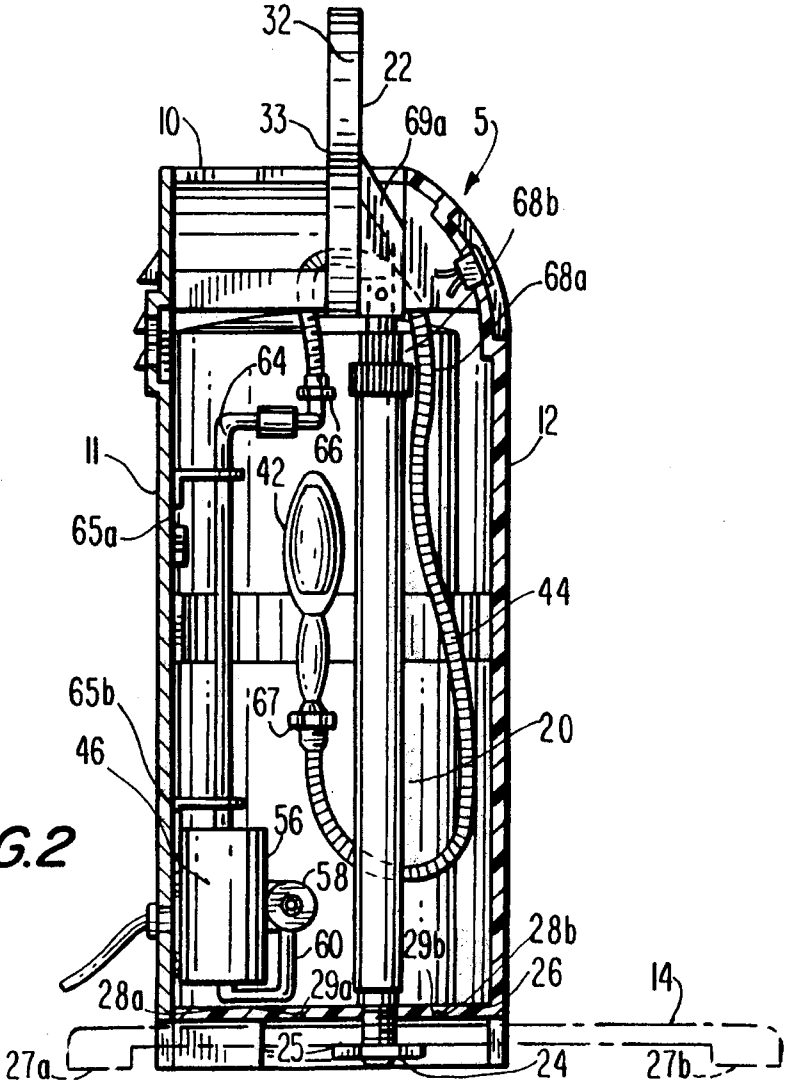
FIG. 2 is a side cross-sectional view of the garment steaming device of FIG. 1 taken along line 2—2 thereof.
Figures 3, 4, 7:
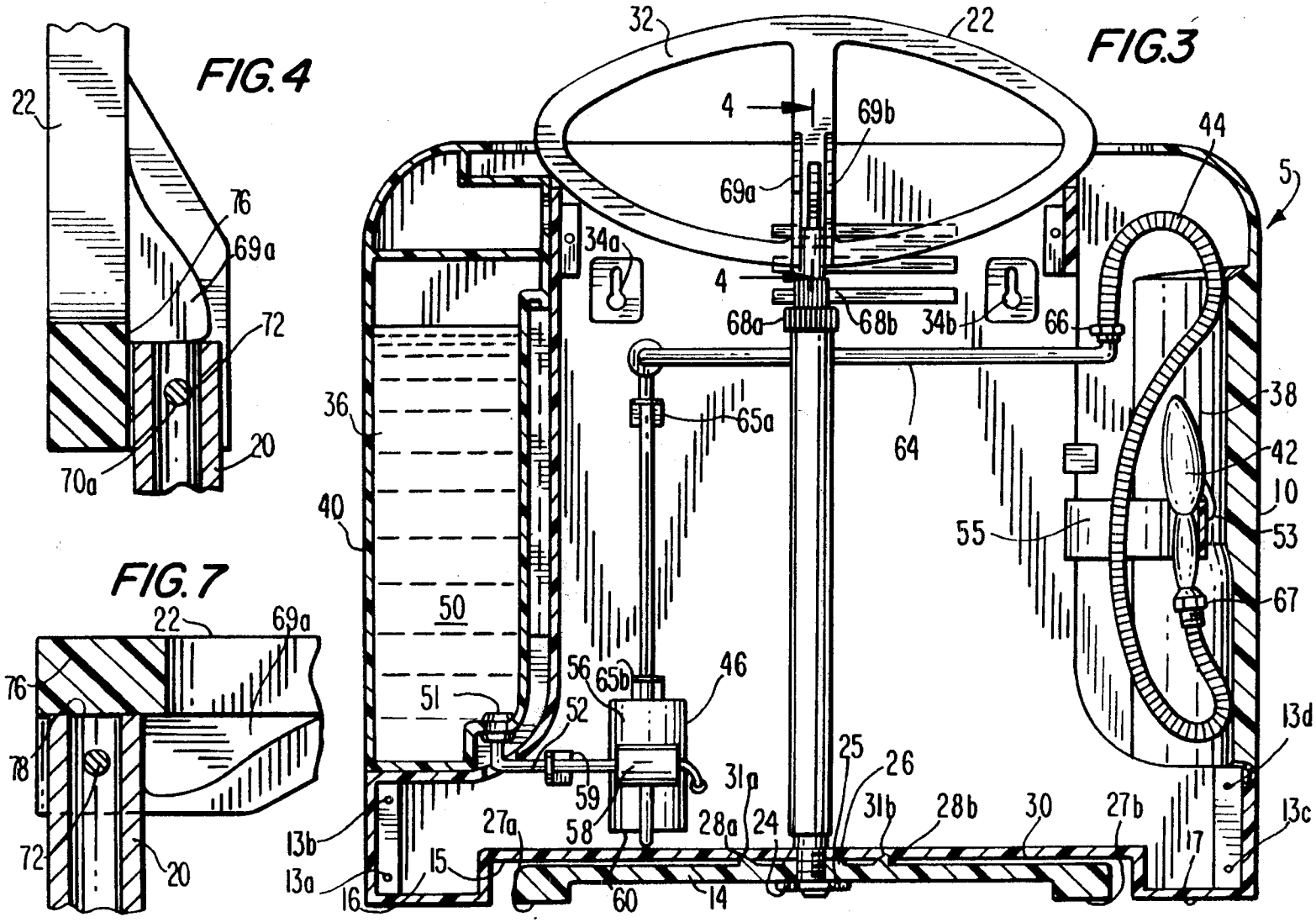
FIG. 3 is a front cross-sectional view of the garment steaming device of FIG. 1 taken along line 3—3 thereof.
FIG. 4 is a side elevational view taken along line 4—4 of FIG. 3 specifically illustrating a first position of a clothes hanger handle pivoted downwardly from a telescoping pole.
FIG. 7 is a side elevational view taken along line 7—7 of FIG. 6 specifically illustrating the clothes hanger handle being pivoted to a second position generally horizontal to the telescoping pole.

Referring now to the drawings, wherein like reference numerals are used throughout and in particular to FIGS. 1–3, there is illustrated a preferred embodiment of a garment steaming device 5 in accordance with the present invention. This garment steaming device is compact, portable and suitable for use in the home, and as will be described in further detail below, is easy to store or hang on a wall.

As is shown in FIG. 1, the garment steaming device 5 of the present invention includes an outer housing 10 enclosing the components of the device 5 when the device is in its storage or non-use configuration. In the preferred embodiment, the outer housing 10 is made of plastic or any other suitable plastic-like material. The housing includes a back panel 11 and a front panel 12 which are interconnected to one another by securing means at attachment points, such as 13*a*, 13*b*, 13*c* and 13*d* (see FIG. 3).

The outer housing 10 can be stabilized on a ground surface by means of an injection molded rotating foot support stand 14. In the storage or carrying position of the device 5 (see FIG. 1), the support stand 14 is contained within a recess 15 formed between two downwardly depending legs 16 and 17 of the outer housing 10. In the use position of the device 5, the support 14 is capable of rotation up to 90° about a telescopic pole 20 which supports a clothes hanger handle 22 to be described in more detail below. The support stand 14 is rotatably supported about the pole 20 by means of a hex nut 24 being fixed to the bottom end 25 of the telescoping pole 20 and an upwardly extending ring 26 formed on the support stand 14 being provided around the pole 20 on the opposite side of the support stand 14 from the hex nut 24 (see FIGS. 2, 3 and 5).

In the use position of the device 5, the stand 14 is rotated 180° such that a pair of downwardly depending legs 27*a* and *b* support the device. The stand 14 is maintained in its rotated position by a pair of detents 28*a* and *b* extending upwardly therefrom engaging corresponding notches 29*a* and *b* provided along the bottom surface 30 of the outer housing 10 which thereby prevents further rotation of the stand. Similarly, these detents 28*a* and *b* engage another set of notches 31*a* and *b* provided along the bottom surface 30 when the stand 14 is in its stored position. In order to minimize any damage to the supporting surface and to ensure that the steaming device can be easily moved, the bottom of the outer housing, such as the legs 16 and 17 and the stand 14, are made of a relatively smooth material. Moreover, the bottom of the housing comprises a smooth rounded surface to allow for sliding of the garment steaming device along a support surface, such as a floor.

In its stored condition of FIG. 1 through 3, the device can be conveniently carried by means of the handle portion 32 of the clothes hanger handle 22 which extends outwardly of the outer housing 10 through opening 33. Moreover, the device 5 in its stored configuration can easily be hung on a vertical surface, such as a wall or door, by means of a pair of keyhole notches 34*a* and *b* being provided in the back panel 11 of the outer housing 10 (see FIG. 3).

The outer housing 10 further includes two storage compartments 36 and 38 (see FIG. 1). The first storage compartment 36 serves as an enclosure for a removable water bottle 40. The second storage compartment serves as an enclosure for a safety steam nozzle 42 and a hose 44 therefore which is connected to a water boiler assembly, generally designated as 46, which is enclosed between the rear and front panels 11 and 12. The detachable compartment 36 can be removed and attached to the outer housing 10 by any suitable attachment arrangement known in the art, such as the bracketing arrangement shown in FIG. 5 wherein a first vertically extending bracket clip 47*a* is provided on a side edge of the rear panel 11 and a corresponding second vertically extending bracket 47*b* is provided along a side edge of the front panel 12 with these two brackets 47*a* and 47*b*, engaging respective recessed grooves 48*a* and *b* provided on the interior face 49 of the water bottle compartment 36 (see FIG. 5, for example). The second compartment 38 can be opened by a hinge member such that the steam nozzle 42 and hose 44 can be removed therefrom.

As is best shown in FIGS. 2 and 3, in its attached condition, water 50 contained in the water bottle compartment 36 may be discharged therefrom into the water boiler assembly 46 by means of a suitable coupling, such as valve coupling 51 and associated piping 52, to be discussed in further detail with respect to FIGS. 16 and 17. When the second compartment 38 is in its attached condition, the safety nozzle 42 and hose 44 may be contained therein by means of a clip member 53 extending from the top surface 54 of the safety nozzle 42 being retained on a support member 55 extending horizontally across generally the mid-section of the second compartment 38.

Figure 5:
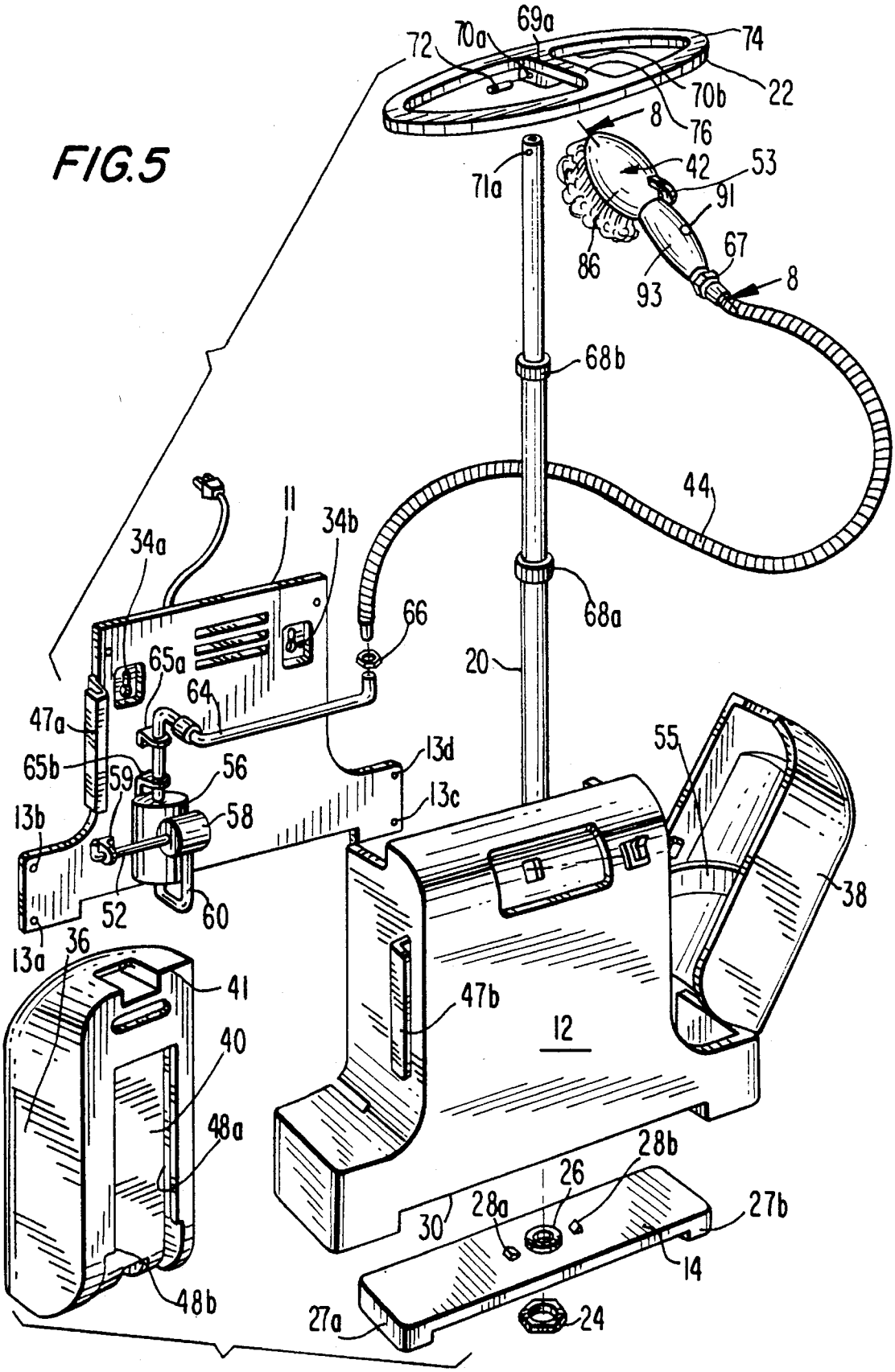
FIG. 5 is an exploded front perspective view of the garment steaming device.

As shown in FIGS. 2, 3 and 5, in order to generate steam for discharge from the safety nozzle 42, the water boiler assembly includes a water boiler 56 and a vacuum break 58 which are secured to the back panel 11 of the housing 10 by appropriate fastening members. The piping 52 leading from the water coupling 51 to the vacuum break 58 is secured to the rear panel by means of an L-shaped bracket 59. This vacuum break 58 controls the flow of water into the boiler 56. The water then passes through additional piping 60 from the vacuum break 58 to the boiler 56 wherein the water is transformed into water vapor (i.e., steam). The steam then exits the boiler 56 through a swivel shaped tube 64 which is secured to the rear panel 11 by means of generally shaped brackets 65*a* and *b*. The steam then passes through hose 44 which is connected to the swivel shaped tube 64 by means of a clamp 66. In the preferred embodiment, the hose 44 is made of a flexible and relatively heat resistant material. It is therefore safe and comfortable to the touch even when steam at a temperature up to 212° F. passes therethrough. The steam is discharged from the safety nozzle 42 (the operation of which will be described in detail below) which is connected to the hose by means of coupling 67.

In accordance with one of the general objects of the present invention, the garment steaming device 5 includes an integral arrangement for holding the garments in place during steaming. In order to achieve this object, the garment steaming device 5 includes the aforementioned telescoping pole 20 and clothes hanger handle 22 pivotally mounted on top of the pole 20. The telescoping pole 20 is capable of being moved between a retracted position (see FIGS. 2 and 3), wherein the pole is contained within the housing 10 and the clothes handle 22 forms an outwardly extending handle 32 for carrying the garment steaming device, and an extended position (see FIGS. 5 and 6), wherein the pole 20 can be extended to various vertical heights and the clothes hanger handle 22 is extended generally horizontally such that a garment to be steam cleaned can be hung thereon.

Figure 6:
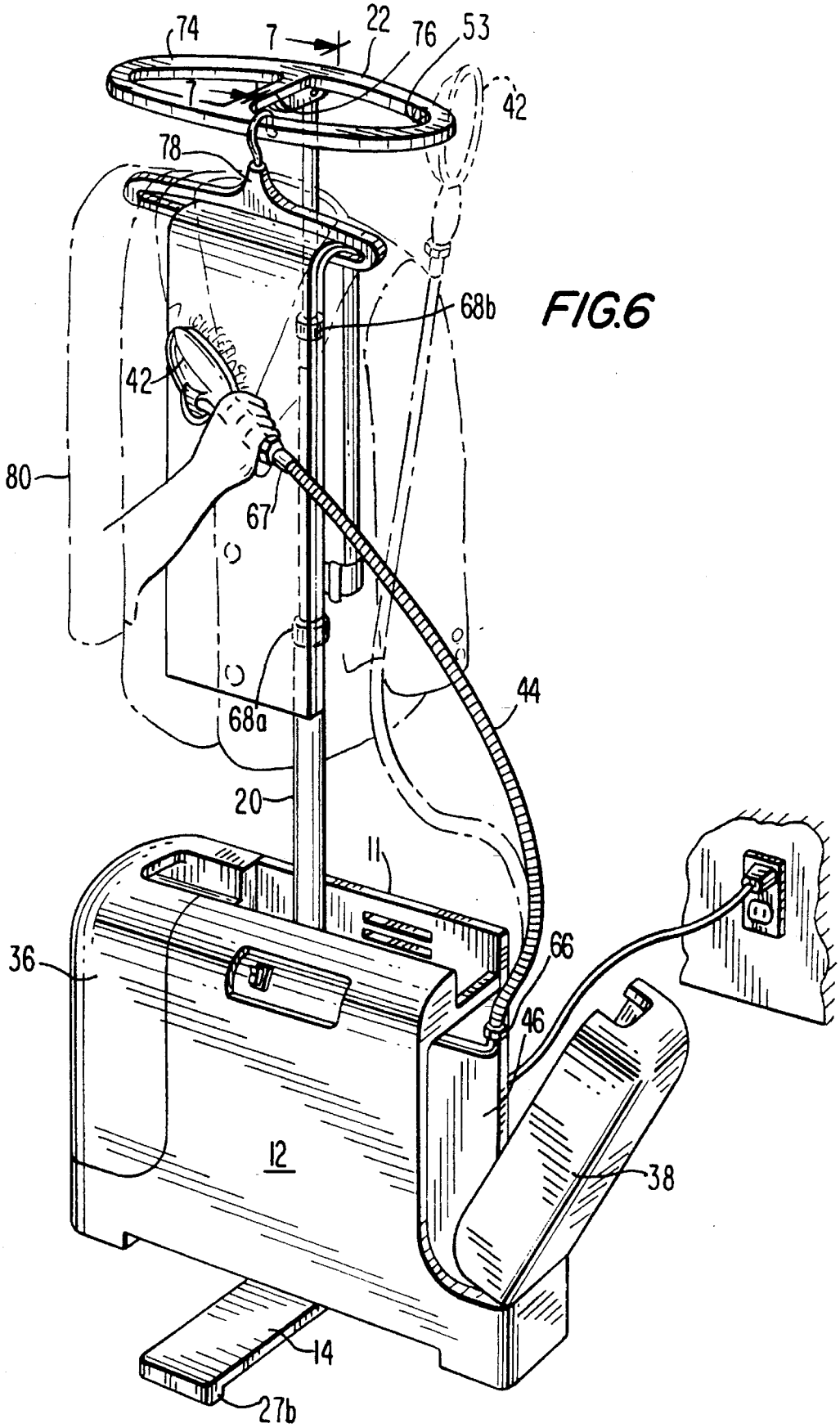
FIG. 6 is a front perspective view of the garment steaming device of FIG. 1 in use with a garment to be steamed hung on the clothes hanger handle which is generally horizontally extended.

As is shown in FIGS. 5 and 6, the telescoping pole 20 includes a plurality of locking mechanisms, such as 68*a* and *b*, which allow the pole 20 to extend to a variety of vertical heights depending on the size of the garment to be steam cleaned, the user's height, etc. Although the locking mechanisms shown in FIGS. 5 and 6 are twist ring locks, the locking mechanisms 68*a* and *b* can be any suitable locks known to those skilled in the art, such as push button locks.

The clothes hanger handle 22 is pivotably mounted to the pole 20 by means of the pin pivot arrangement shown in FIGS. 4, 5 and 7. As is best shown in FIG. 5, the clothes hanger handle 22 includes a pair of angled mounted flanges 69*a* and *b* extending downwardly therefrom. These mounting flanges 69*a* and *b* have corresponding pin openings 70*a* and *b*. The hanger 22 is then positioned on the pole 20 such that the pin openings 70*a* and *b* are aligned with corresponding holes 71*a* and *b* provided in the pole 20. A pivot pin 72 is then inserted through the pin openings 70*a* and *b* and the holes 71*a* and *b* to pivotably retain the clothes hanger handle 22 with respect to the pole 20. As such, the clothes hanger handle 22 is pivotably movable between a generally vertical position, wherein the pole 20 is collapsed in the housing 10 and the clothes hanger handle 22 is partially contained within housing 10 and a portion 32 thereof extends outwardly through opening 33 to form a carrying handle, and a generally horizontal position, wherein after the pole 22 has been vertically extended, the clothes hanger handle 22 is pivoted to act as a hanger for the garment to be steam cleaned.

In order to hang clothes thereon, the clothes hanger handle 22 includes a relatively thin oval-shaped member 74 with a central web member 76 extending therebetween. As is shown in FIG. 6, a clothes hanger 78 with a garment 80 hung therein can be retained by the oval-shaped member 74. In addition, the safety nozzle 42 can be retained to the oval shaped member 74 by means of the clip 53.

When the clothes hanger handle 22 is pivoted to its generally horizontal position, the clothes hanger handle 22 is restrained from further movement by the bottom surface 76 of the clothes hanger handle 22 abutting the top surface 78 of the pole 20. Accordingly, the clothes hanger 22 is reliably retained in its generally horizontal position.

The safety nozzle 42 of the garment steaming device of the present invention is best illustrated in FIGS. 8 through 14. In accordance with one of the general objects of the present invention, this safety nozzle 42 protects the user against burning as a result of accidental contact with the nozzle. Moreover, the safety nozzle 42 provides a means for comfortably dispensing steam for an extended period of time, with a provision for automatic steam shutoff and retraction of a hot nozzle plate 80 into a cover assembly 82 in the event that the safety nozzle is left unattended or dropped.

The safety nozzle includes an inner or steam chamber assembly, generally designated as 84, and an outer or wand assembly, generally designated as 86. The inner or steam chamber assembly 84 generally comprises the nozzle plate 80, a steam chamber housing 88 integrally connected to the nozzle plate 80 and enclosing a steam chamber 89, a steam tube 90, and a rotatable knob 92. The outer or wand assembly 86 generally comprises the cover assembly 82, a nozzle plate latch 91, and a latch spring 94. The latch 91 protrudes above the surface of the grip area 93 of the safety nozzle 42 when released and is flush, matching the contour of the nozzle area, when depressed. As will be discussed in more detail below, the latch spring 94 provides the force to extend the plate latch 91.

As is best shown in FIG. 8, a rotary valve 85 which is particularly connected to the knob 92 controls the flow of steam into steam chamber 89. Moreover, a wand spring 97 causes the steam chamber assembly 84 and thus the nozzle plate 80 to rotate when the latch 91 is released.

In the inner or steam chamber, the steam tube 90 is connected at one end thereof to the hose 44 and at the other end thereof to the steam chamber 88. The knob 92 is operatively connected to the nozzle plate 80 and the steam chamber housing 88 by means of the steam tube 90, and accordingly, when the knob 92 is turned, the nozzle plate 80 and the steam chamber housing 88 can be rotated 180° from a retracted position (see FIGS. 11–13) to a use or steaming position (see FIGS. 8–10). The nozzle plate 80 also includes a plurality of perforations, such as 92*a* and *b* (see FIG. 14), provided therein of a pre-determined configuration through which steam is emitted from the steam chamber 89 when the nozzle plate is in its use or steaming position. The predetermined configuration of the perforations 94*a* and *b* is designed for optimal steam output. In the retracted position, the nozzle plate 80 and thus its perforations are rotated into the interior of the safety nozzle 42 and are not exposed. As shown in FIG. 11, in the retracted position of the nozzle plate, the steam chamber housing 88 closes the opening 95 of the cover assembly 82 which was previously occupied by the nozzle plate 80.

As is shown in FIG. 11, when the steamer is not in use, the cover assembly 82 encapsulates the steam tube 90, the steam chamber 89 and the nozzle plate 80. As aforementioned, the nozzle plate latch 91 connected to the latch spring 94 protrudes above the surface of the grip area 93 in the cover assembly 82. When the steamer is not in use, the latch spring 94 retains the latch 91 in its protruding position, thereby preventing inner assembly 84 from rotating to the use position of the nozzle plate 80 and thereby exposing the nozzle plate 80.

During normal operation, the operator picks up the safety nozzle 42 by the grip area 93, naturally depressing the latch 91. Upon depression of the latch 91, the nozzle plate 80 is maintained in its retracted position with the cavity side 95 of the cover assembly 82 enclosed by the steam chamber housing 88, as a result of the biasing force applied by wand spring 94. In its retracted position, the nozzle plate 80 is provided in the interior of the safety nozzle 42 and is therefore inaccessible. In the retracted position of the nozzle plate 80, the rotary valve 85 is closed and therefore steam cannot pass into the steam chamber 89.

When steam is desired, the operator rotates the knob 92, which, being fixed to the steam tube 90 which in turn is fixed to the steam chamber housing 88 and nozzle plate 80, causes the entire inner assembly 84 to rotate within the cover assembly 82, against the force of the wand spring 97. When 180° of rotation is achieved, the nozzle plate latch 91 (by virtue of the hand preload) is forced into a recess 98 provided in the inner assembly 84, thereby preventing the inner assembly 84 from reversing direction despite the biasing force of the wand spring 97. The nozzle plate latch 91 is now flush with the grip area 93 rendering the safety nozzle comfortable to hold. In its use position, the nozzle plate 80 is now provided in the nozzle housing cavity 95 facing away from the operator. With the rotary valve 85 now open, steam is allowed to flow into the steam chamber 89 and through the perforation 92*a, b*, etc. of the nozzle plate 80.

When the grip area 93 is released by the operator, the latch spring 94 forces the nozzle plate latch 91 away from the recess 98 and the wand spring 97 thereby rotates the steam chamber assembly 180 degrees, thereby retracting the nozzle plate 80 and closing the rotary valve 85 to prevent the flow of steam into the steam chamber 89. Accordingly, the safety nozzle 42 of the garment steaming device of the present invention has been designed to reduce the likelihood of inadvertent burning of the operator.

Moreover, the safety nozzle 42 of the garment steaming device is of a pre-determined angular shape which provides for fast operation over a large surface area and allows access to hard to reach places of the clothing article to be steamed, such as under shirts and collars.

As is shown in FIG. 15, in another preferred embodiment of the garment steaming device of the present invention, the safety nozzle 42 and hose 44 may also be stored in an external cavity 100 provided with a rung member 102 around which the hose 44 can be retained, instead of being stored internally within the second storage compartment 38 of FIGS. 1–3 and 5–6.

The water coupling 51 which provides the quick disconnect of the water bottle compartment 36 and results in the ability to conveniently remove the water bottle compartment 36 without causing spillage of the remaining water in the bottle is illustrated in FIGS. 16 and 17. No drip removal and repositioning of the water bottle compartment 36 is accomplished through the water coupling 51 which comprises an inner tube assembly 102 secured to the bottom of the water bottle compartment 36 and an outer tube assembly 104 secured to an injection molded outer shell 106 of the outer housing 10 as shown in FIG. 16. The inner tube assembly 102 is secured to the water bottle 36 by means of an inner tube 103 having a threaded 0-ring member 104 and a hex nut 106 which meshes with the threaded portion 107 of 0-ring member 104. The inner tube assembly also includes a rod member 108 which is positioned inside the inner tube 103.

An e-ring 110, as shown in FIGS. 16 and 17, is secured to the bottom of the rod member 108 and supports a spring 112 which is positioned around the rod member 108 between the e-ring 110 and fins 111*a, b* and *c* of spring plate abutment 114 molded to the rod member 108. When the spring 112 is in its natural extended position, it preloads a generally round cap 116 fixed to the top of the rod member 108 and a sealing member 118 connected to the rod member 108 below the cap 116 so that the cap 116 and sealing member 118 cover the central top opening 117 of the inner tube 103, thereby preventing water from entering the inner tube assembly 102 from the water bottle compartment 36.

The outer tube 119 of the outer tube assembly 104 is secured at its lower end to the tubing 52 by means of a hose clamp 120. At its upper end, the outer tube 119 is secured to the injection molded outer shell 106 by means of a threaded 0-ring member 122 and a hex nut 124. The outer tube 119 is provided with a rectangular water release valve 124 which is located at the upper end thereof.

After the water bottle compartment 36 has been filled with water through opening 41, the compartment 36 is repositioned on the outer housing 10 such that the water bottle compartment 36 is placed onto the injection molded outer shell 106. In this connected position, the rod 108 of the inner tube assembly 102 contacts the water release valve 124 of the outer assembly 21 causing compression of the spring 112 between the e-ring 110 and spring plate 114. As the spring 112 is compressed, the cap 116 and sealing member 118 are separated from the central top opening 117 of the inner tube 103 thereby allowing the water contained in the water bottle compartment 36 to flow through the inner tube 103 and the outer tube 119 into the tubing 52.

The garment steaming device of the present invention also includes an additional safety feature which provides an indication of low water level in the water bottle compartment 36 and automated shut-off of the device when a predetermined low water level is present. As shown in FIG. 18, the front panel 12 has a lighted power on/off switch 124 which blinks to indicate that a low water level is present in the water bottle compartment 36. This is accomplished by means of a low level water sensor, generally designated as 126. In the preferred embodiment, the low level water sensor 126 employs a moveable float 128 having a vinyl magnet 129 secured to the top thereof (see FIG. 19). This float 128 is keyed to the inside surface of the water bottle by means of a keyway 130 (see FIG. 20). The moveable float 128 rises and falls along the keyway 130 with the level of water, such as 131, in the water bottle compartment.

As the level of water in the water bottle compartment decreases, the moveable float 128 recedes along the keyway 130. As such, the moveable float 128 comes into proximity with a Hall effect sensor 130 which is mounted inside the housing 10 by means of two hex nuts 132 and 134 at a predetermined position with respect to the desired minimum water level to be maintained in the water bottle compartment 36. This position allows for a predetermined amount of water to remain in the bottle when the lighted power switch 124 begins to blink.

The Hall effect sensor 130 is connected to a PC board 136 which is in turn connected to the lighted power switch 124. As the float 128 comes into proximity with the Hall effect sensor 130, the magnet 129 communicates with the Hall effect sensor 130 which in turn causes a signal to be sent through the wire 138 to the PC board 136, which causes the lighted power switch 124 to blink, indicating to the operator the minimum water level in the water bottle compartment 36 has been reached and in addition provides for automatic shut-out of the garment steaming device.

Based upon the foregoing, it will be appreciated that a garment steaming device has been designed which is portable and suitable for use in the home. In addition, this garment steaming devices provides for fast operation over a large surface area and allows access to hard to reach places of the clothing article to be steamed. This garment steaming device also advantageously includes an integral arrangement for holding the garments in place during steaming. Further, a quick disconnect water bottle is also provided in this garment steaming device which results in the ability to conveniently remove the water bottle without causing spillage of the remaining water in the bottle. Moreover, a safety nozzle of this garment steaming device has been designed which is inaccessible to accidental contact thereby greatly reducing the danger of burning to the operator. An additional safety feature is also included in this garment steaming device with the inclusion of a low water level sensor to indicate when a minimum level of water has been reached in the water bottle compartment.

While the present invention has been particularly shown and described with reference to a preferred embodiment, it will be readily apparent to those of ordinary skill in the art that various changes and modifications may be made therein without departing from the spirit and scope of the invention. It is intended that the appended claims be interpreted as including the foregoing as well as various other such changes and modifications.

What is claimed is:

1. A portable garment steaming device for steaming an article of clothing comprising:

a housing;

a clothes hanger assembly for hanging the article of clothing to be steamed;

a safety nozzle assembly through which steam is emitted for steaming the article of clothing; and a water bottle compartment for supplying water to be generated as steam for said safety nozzle assembly;

wherein said clothes hanger assembly, said safety nozzle assembly and said water bottle compartment are self-contained with said housing;

wherein said safety nozzle assembly comprises a safety nozzle for emitting steam on the article of clothing to be steamed, a hose operatively connected to said safety nozzle for carrying the steam to said safety nozzle, and a nozzle plate having a plurality of perforation through which steam is emitted: and means for rotating said nozzle plate from a use position, wherein said nozzle plate is in a position such that steam can be emitted toward the article to be steamed, and a retracted position, wherein said nozzle plate is rotated into an inaccessible position such steam cannot be emitted through its perforations.

2. The portable garment steaming device of claim 1 wherein said nozzle plate rotating means includes knob means operatively connected to said nozzle plate to rotate said nozzle plate between its use and retracted positions.

3. The portable garment steaming device of claim 1 wherein said nozzle plate rotating means includes rotary valve means operatively connected to said knob means for permitting steam to pass from said hose into said safety nozzle.

4. The portable garment steaming device of claim 1 wherein said nozzle plate rotating means includes latch means for retaining said nozzle plate in said retracted position and preventing further rotation thereof.

5. The portable garment steaming device of claim 4 wherein said latch means is a spring-mounted latch.

6. A portable garment steaming device for steaming an article of clothing comprising:

a housing;

means for applying steam on the article of clothing to be steamed provided with said housing; and a clothes hanger assembly self-contained within said housing, said clothes hanger assembly including a clothes hanger pivotally mounted thereof and means for adjusting the vertical position of said clothes hanger such that said clothes hanger is movable between a collapsed position, wherein said clothes hanger is partially contained within said housing, and an extended position, wherein said clothes hanger can be positioned at heights such that articles of clothing of different sizes can be hung thereon for steaming, said means for adjusting the vertical position of said clothes hanger including a vertically extending telescoping pole having at least one locking means provided thereon for setting the vertical position of the clothes hanger.

7. The portable garment steaming device of claim 6 wherein said clothes hanger assembly further includes pivot mounting means for pivotally mounting said clothes hanger to an end of said telescoping pole such that said clothes hanger can be pivotally moved between a generally vertical position, wherein a portion of said clothes hanger is confined within said housing, and a generally horizontal position, wherein the article of clothing to be steamed can be hung thereon.

8. The portable garment steaming device of claim 7 wherein said pivot mounting means comprises:

a pair of angled mounting flanges extending downwardly from said clothes hanger, said angled mounting flanges having a pair of pin openings;

a pair of corresponding holes provided on said telescoping pole such that when said mounting flange is mounted on said telescoping pole, said pin openings are aligned with said corresponding holes; and a pivot pin being inserted through said aligned pin openings and holes to thereby pivotably mount said clothes hanger with respect to said telescoping pole.

9. The portable garment steaming device of claim 8 wherein in said generally horizontal position, said clothes hanger is restrained from further movement by a bottom surface of said clothes hanger abutting a top surface of said telescoping pole.

10. The portable garment steaming device of claim 7 wherein in said generally vertical position, a portion of said clothes hanger is exposed outwardly of said housing to form a carrying handle.

11. A portable garment steaming deice for steaming an article of clothing comprising:

a housing:

a safety nozzle assembly self-contained within said housing through which steam is emitted for steaming the article of clothing; said safety nozzle assembly comprising a safety nozzle for emitting steam on the article of clothing to be steamed and a hose operatively connected to said safety nozzle for carrying the steam to said safety nozzle, said safety including a rotatable nozzle plate having a plurality of perforations through which steam is emitted; and means for rotating said nozzle plate is moved to a position such that steam can be emitted toward the article to be steamed, and a retracted position, wherein said nozzle plate is rotated into an inaccessible position such that steam cannot be emitted through its said perforations.

12. The portable garment steaming device of claim 11 wherein said nozzle plate rotating means includes knob means operatively connected to said nozzle plate to rotate said nozzle plate between its use and retracted positions.

13. The portable garment steaming device of claim 11 wherein said nozzle plate rotating means includes rotary valve means operatively connected to said knob means for permitting steam to pass from said hose into said safety nozzle.

14. The portable garment steaming device of claim 11 wherein said nozzle plate rotating means includes latch means for retaining said nozzle plate in said retracted position and preventing further rotation thereof.

15. The portable garment steaming device of claim 11 wherein said safety nozzle can be stored in a second compartment hingedly connected to said housing.

16. A portable garment steaming device for steaming an article of clothing comprising:

a housing;

a clothes hanger assembly for hanging the article of clothing to be steamed;

a safety nozzle assembly through which steam is emitted for steaming the article of clothing; and a water bottle compartment for supplying water to be generated as steam for said safety nozzle assembly;

wherein said clothes hanger assembly, said safety nozzle assembly and said water bottle compartment are self-contained within said housing, and wherein said clothes hanger assembly includes a clothes hanger pivotally mounted thereon and means for adjusting the vertical position of said clothes hanger such that said clothes hanger is movable between a collapsed position, wherein said clothes hanger is partially contained with said housing, and an extended position, wherein said clothes hanger can be positioned at varying heights such that articles of clothing of different sizes can be hung thereon for steaming.

17. The portable garment steaming device of claim 16 wherein said means for adjusting the vertical position of said clothes hanger includes a vertically extending telescoping pole having at least one locking means provided thereon for setting the vertical position of said clothes hanger.

18. The portable garment steaming device of claim 17 wherein said clothes hanger assembly further includes pivot mounting means for pivotally mounting said clothes hanger to an end of said telescoping pole such that said clothes hanger can be pivotally moved between a generally vertical position, wherein a portion of said clothes hanger is confined within said housing, and a generally horizontal position, wherein the article of clothing to be steamed can be hung thereon.

19. The portable garment steaming device of claim 18 wherein said pivot mounting means comprises:

a pair of angled mounting flanges extending downwardly from said clothes hanger, said angled mounting flanges having a pair of pin openings;

a pair of corresponding holes provided on said telescoping pole such that when said mounting flange is mounted on said telescoping pole, said pin openings are aligned with said corresponding holes; and a pivot pin being inserted through said aligned pin openings and holes to thereby pivotally mount said clothes hanger with respect to said telescoping pole.

20. The portable garment steaming device of claim 19 wherein in said generally horizontal position, said clothes hanger is restrained from further movement by a bottom surface of said clothes hanger abutting a top surface of said telescoping pole.

21. The portable garment steaming device of claim 18 wherein in said generally vertical position, a portion of said clothes hanger is exposed outwardly of said housing to form a carrying handle.

22. The portable garment steaming device of claim 16 wherein said water bottle compartment is releasably detachable from said housing.

23. The portable garment steaming device of claim 16 and further including means for releasably disconnecting said water bottle compartment from said housing without causing spillage of the water in the bottle compartment.

24. The portable garment steaming device of claim 23 wherein said means for releasably disconnecting said water bottle compartment from said housing includes:

an inner tube assembly secured to said water bottle compartment, said inner tube assembly including an inner tube having a central top opening at the top thereof and a rod member extending through said inner tube, said rod member having an e-ring mounted at an end thereof and a cap member at another end thereof for covering said central top opening, said rod member further having a spring plate fixed thereto between said e-ring and said cap member, said inner tube assembly further having spring means biased between said e-ring and said spring plate;

an outer tube assembly secured to said housing for communicating with tubing operatively connected to said safety nozzle assembly, said outer tube assembly having an outer tube with a water release valve provided therein; and wherein when said water bottle compartment is connected to said housing, said rod member of said inner tube assembly contacts said water release valve of said outer tube assembly thereby compressing said spring means and separating said cap member from said central top opening to permit water to pass from said water bottle compartment to said outer tube and then pass through said water release valve into said outer tube, and wherein when said water bottle compartment is disconnected from said housing, said spring means returns to its natural state thereby closing said central top opening of said inner tube by said cap member to seal the remaining water within said water bottle compartment.

25. A portable garment steaming device for steaming an article of clothing comprising:

a housing;

a clothes hanger assembly for hanging the article of clothing to be steamed;

a safety nozzle assembly through which steam is emitted for steaming the article of clothing; and a water bottle compartment for supplying water to be generated as steam for said safety nozzle assembly;

wherein said clothes hanger assembly, said safety nozzle assembly and said water bottle compartment are self-contained within said housing, wherein said safety nozzle assembly comprises a safety nozzle for emitting steam on the article of clothing to be steamed and a hose operatively connected to said safety nozzle for carrying the steam to said safety nozzle, and wherein said safety nozzle can be stored in a second compartment hingedly connected to said housing.

26. A portable garment steaming device for steaming an article of clothing comprising:

a housing;

a clothes hanger assembly for hanging the article of clothing to be steamed;

a safety nozzle assembly through which steam is emitted for steaming the article of clothing; and a water bottle compartment for supplying water to be generated as steam for said safety nozzle assembly;

a means for indication of low water level in said water bottle compartment and means for providing automatic shut off for the device;

wherein said clothes hanger assembly, said safety nozzle assembly and said water bottle compartment are self-contained within said housing, and wherein said low water level indication means includes Hall effect sensor means provided in said housing for setting the pre-determined minimum water level to be present in said water bottle compartment before automatic shut-off of the device.

27. The portable garment steaming device of claim 26 wherein said low water indication means further includes water level sensor means for measuring the water level in said water bottle compartment.

28. The portable garment steaming device of claim 27 wherein said water level sensor means includes a movable float floating on the water level in said water bottle compartment and movable within said water bottle compartment in a vertically disposed keyway, said movable float having magnet means attached thereto for relaying a magnetic signal to said Hall effect sensor when said magnet means is vertically aligned with said Hall effect sensor at said predetermined minimum water level.

29. The portable garment steaming device of claim 28 wherein said Hall effect sensor is electrically connected to circuit board means and said circuit board means is electrically connected to switch means such that when said Hall effect sensor receives said magnetic signal from said magnet means of said movable float, said Hall effect sensor sends an electrical signal to said circuit board means causing a light indication means of said switch means to blink indicating that the minimum water level has been reached in said water bottle compartment and providing for automatic shut-off of the device.

30. A portable garment steaming device for steaming an article of clothing comprising:

a housing;

a clothes hanger assembly for hanging the article of clothing to be steamed;

a safety nozzle assembly through which steam is emitted for steaming the article of clothing; and a water bottle compartment for supplying water to be generated as steam for said safety nozzle assembly;

a means for stabilizing said housing on a ground support surface;

wherein said clothes hanger assembly, said safety nozzle assembly and said water bottle compartment are self-contained within said housing.

31. The portable garment steaming device of claim 30 wherein said stabilizing means includes a rotating foot support stand for supporting said housing, said foot support stand being rotatably supported to said clothes hanger assembly.

32. The portable garment steaming device of claim 31 wherein said rotating foot support stand is movable between a storage position, wherein said support stand is contained within a recess formed in said housing, and a use position, wherein said support stand can be rotated up to 180° such that a pair of legs depending downwardly from said stand support said housing.

33. The portable garment steaming device of claim 32 wherein in order to retain said support stand in said storage and use positions, a pair of detents provided in said stand engage corresponding mating notches provided in said housing.

34. The portable garment steaming device of claim 31 wherein said rotating foot support stand is made of a relatively smooth material in order to minimize any damage to the ground support surface and ensure that the device can be easily moved.

35. A portable garment steaming device for steaming an article of clothing comprising:

a housing;

a safety nozzle assembly through which steam is steaming the article of clothing;

a water bottle compartment for supplying water to be generated as steam for said safety nozzle assembly, said water bottle compartment being releasably detachable from said housing;

means for releasably disconnecting said water bottle compartment from said housing without causing spillage of the water in the bottle compartment;

wherein said means for releasably disconnecting said water bottle compartment from said housing includes:

an inner tube assembly secured to said water bottle compartment, said inner tube assembly including an inner tube having a central top opening at the top thereof and a rod member extending through said inner tube, said rod member having an e-ring mounted at an end thereof and a cap member at another end thereof for covering said central top opening, said rod member further having a spring plate fixed thereto between said e-ring and said cap member, said inner tube assembly further having spring means biased between said e-ring and said spring plate;

an outer tube assembly secured to said housing for communicating with tubing operatively connected to said safety nozzle assembly, said outer tube assembly having an outer tube with a water release valve provided therein; and wherein when said water bottle compartment is connected to said housing, said rod member of said inner tube assembly contacts said water release valve of said outer tube assembly thereby compressing said spring means and separating said cap member from said central top opening to permit water to pass from said water bottle compartment to said outer tube and then pass through said water release valve into said outer tube, and wherein when said water bottle compartment is disconnected from said housing, said spring means returns to its natural state thereby closing said central top opening of said inner tube by said cap member to seal the remaining water within said water bottle compartment.

36. A portable garment steaming device for steaming an article of clothing comprising:

a housing;

a safety nozzle assembly through which steam is steaming the article of clothing;

a water bottle compartment for supplying water to be generated as steam for said safety nozzle assembly; and means for indication of low water level in said water bottle compartment and means for providing automatic shut-off of the device;

wherein said low water level indication means includes Hall effect sensor means provided in said housing for setting the predetermined minimum water level to be present in said water bottle compartment before automatic shut-off of the device.

37. The portable garment steaming device of claim 36 wherein said low water indication means further includes water level sensor means for measuring the water level in said water bottle compartment.

38. The portable garment steaming device of claim 37 wherein said water level sensor means includes a movable float floating on the water level in said water bottle compartment and movable within said water bottle compartment in a vertically disposed keyway, said movable float having magnet means attached thereto for relaying a magnetic signal to said Hall effect sensor when said magnet means is vertically aligned with said Hall effect sensor at said predetermined minimum water level.

39. The portable garment steaming device of claim 38 wherein said Hall effect sensor is electrically connected to circuit board means and said circuit board means is electrically connected to switch means such that when said Hall effect sensor receives said magnetic signal from said magnet means of said movable float, said Hall effect sensor sends an electrical signal to said circuit board means causing a light indication means of said switch means to blink indicating that the minimum water level has been reached in said water bottle compartment and providing for automatic shut-off of the device.

* * * * *